US007705573B2

(12) United States Patent
Noda

(10) Patent No.: US 7,705,573 B2
(45) Date of Patent: Apr. 27, 2010

(54) CONSTANT VOLTAGE CIRCUIT

(75) Inventor: Ippei Noda, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 261 days.

(21) Appl. No.: 11/988,210

(22) PCT Filed: May 2, 2007

(86) PCT No.: PCT/JP2007/059806

§ 371 (c)(1),
(2), (4) Date: Jan. 3, 2008

(87) PCT Pub. No.: WO2007/129765

PCT Pub. Date: Nov. 15, 2007

(65) Prior Publication Data

US 2009/0121693 A1 May 14, 2009

(30) Foreign Application Priority Data

May 9, 2006 (JP) ..... 2006-130566

(51) Int. Cl.
*G05F 1/565* (2006.01)

(52) U.S. Cl. ..... 323/273

(58) Field of Classification Search ..... 323/265, 323/266, 268, 271, 273, 280, 282
See application file for complete search history.

(56) References Cited

U.S. PATENT DOCUMENTS 5,373,226 A * 12/1994 Kimura ..... 323/313
6,995,548 B2 * 2/2006 Walters et al. ..... 323/272
2005/0088153 A1 4/2005 Suzuki
2005/0151527 A1 7/2005 Noda
2005/0231180 A1 * 10/2005 Nagata et al. ..... 323/268
2007/0001513 A1 1/2007 Noda
2007/0120546 A1 * 5/2007 Hagino ..... 323/282
2007/0262763 A1 * 11/2007 Suzuki ..... 323/284
2009/0015222 A1 * 1/2009 Takagi et al. ..... 323/280

FOREIGN PATENT DOCUMENTS

JP 2000-047740 2/2000
JP 2000-284843 10/2000
JP 2004-062329 2/2004
JP 2004-110655 4/2004
JP 2005-84869 3/2005
JP 2005-174208 6/2005
JP 2005-196354 A 7/2005
JP 2005-353037 12/2005
JP 2006-018774 1/2006

* cited by examiner

*Primary Examiner*—Adolf Berhane
(74) *Attorney, Agent, or Firm*—Dickstein Shapiro LLP

(57) ABSTRACT

A voltage change detecting circuit part amplifies an output signal of a differential amplifying circuit so that a slew rate thereof may be larger than that of a control signal output from a first error amplifying circuit to an output transistor, responding to change of an output voltage output from an output terminal quicker than a control signal output from the first error amplifying circuit to a first transistor, and causing a discharging circuit part to carry out discharging operation.

22 Claims, 7 Drawing Sheets

CONSTANT VOLTAGE CIRCUIT

TECHNICAL FIELD

The present invention relates to a constant voltage circuit which can rapidly respond to a steep change in a load, and, in particular, to a constant voltage circuit having a low electric current consumption, and being able to remarkably reduce a change in an output voltage by instantaneously detecting the change in the output voltage occurring due to a load change.

BACKGROUND ART

In a constant voltage circuit converting an input voltage into an output voltage having a constant voltage and outputting the same, ordinarily, a voltage obtained from dividing the output voltage is compared with a reference voltage, and feedback control is carried out to an output transistor for outputting the output voltage, in such a manner as to minimize a voltage difference. Therefore, some time delay is required for returning the output voltage to a predetermined voltage value after the change in the output voltage is transmitted to the output transistor. Such a time delay required for the transmission corresponds to a response delay. When the response delay is large, the output voltage may change greatly for a case where, for example, the load electric current transitionally change greatly, and, in the worst case, the output voltage may lower under a guaranteed lowest operation voltage of a circuit connected to the output terminal, and thus, an apparatus using the circuit may have a trouble.

In many cases, such a response delay depends on an input capacitance of a transistor included in the constant voltage circuit, a phase compensating capacitance, and values of electric currents for charging or discharging these capacitances. Especially, an input capacitance of an output transistor used for outputting a large electric current or the phase compensating capacitance for phase compensation may be very large, and thus, it may cause a serious response delay. That is, in order to improve a response speed, the above-mentioned input capacitance should be reduced, or, the value of the electric current for charging or discharging the capacitance should be increased. However, the input capacitance is determined approximately by a size of the output transistor required for outputting a large electric current or a value of the capacitance required for keeping circuit stability. Therefore, actually a method by increasing the electric current value for charging or discharging the input capacitance may be used in common. In order to increase the charging or discharging electric current, a bias current value should be increased. As a result, an electric current consumption in the constant voltage circuit itself increases accordingly.

Recently, in consideration of an environmental problem, energy saving in electric appliances is required. In particular, as to a constant voltage circuit used in a portable device driven by a battery, energy saving in the constant voltage circuit must be achieved in order to elongate a possible continuous operation time of the device. For this purpose, it is preferable to lower, as much as possible, an electric current consumption required for operating a control circuit controlling an output transistor in the constant voltage circuit. Further, various applications are mounted in the portable device, the constant voltage circuit which can output a larger electric current, can operate with a reduced voltage, and can output a low voltage, is required, and thus, the size of the output transistor increases accordingly. As a result, serious degradation in the response speed may occur accordingly. Further, a circuit connected to the constant voltage circuit has a range of a guaranteed operation voltage, which is recently reduced due to miniaturization of the circuit which is recently demanded. As a result, further reduction in output voltage fluctuation of the constant voltage circuit is required.

In order to solve these problems, as a first method in the prior art to improve the output voltage response speed in response to a possible steep change in a load electric current, Japanese Laid-Open Patent Application 2000-47740 for example discloses a configuration in which, when the output voltage lowers, the reduction in the output voltage is transmitted to a non-inverted input end of a comparator via a capacitor, and, when a voltage in the non-inverted input end of the comparator thus lowers, a PMOS transistor controlled by an output signal of the comparator is turned on, and thus the output terminal is charged. Thereby, the reduction in the output voltage is controlled.

As a second method in the prior art, Japanese Laid-Open Patent Application 2005-47740 for example discloses a configuration in which, as shown in FIG. 7, normally an output voltage Vout is made constant by means of carrying out control of operation of an output transistor M101 by a first error amplifier AMPa having a superior linearity. When the output voltage Vout lowers steeply, before the first error amplifier AMPa responds thereto and carries out control of operation of the output transistor M101, a second error amplifier AMPb having superior response is used to carry out control of operation of the output transistor M101 for a predetermined duration, so as to make the output voltage Vout constant. By configuring so, it is possible to improve an output voltage response speed with respect to a possible steep change in an input voltage or a load electric current. As a result, it is possible to provide a constant voltage circuit having both superior linearity and superior response.

In a third method in the prior art, Japanese Laid-Open Patent Application 2006-18774 for example discloses a configuration in which an operation electric current of a voltage amplifying circuit is controlled with a detection of a change in a power source voltage, and thereby, an electric current consumption reduces during normal operation having no change in the power source voltage, while, in a transition response occasion in which the power source voltage changes, response improves with the increased electric current consumption.

However, in the above-mentioned first method, the PMOS transistor charging the output terminal should have sufficient capability for compensating a possible steep change in the load electric current. As a result, the size of the PMOS transistor should be very large. As a result, a capacitance in a gate of the PMOS transistor increases. Accordingly, in order to rapidly turn on the PMOS transistor for achieving rapid response, an electric current consumption in the comparator controlling the PMOS transistor should increase. As a result, the electric current consumption increases accordingly.

In the above-mentioned second method, the second error amplifier AMPb detecting sleep reduction in the output voltage is previously provided with an offset such that the second error amplifier AMPb should not influence the output transistor M101 when no steep reduction in the output voltage occurs. That is, a change in the output value cannot be detected when the change in the voltage is less than the offset voltage of the second error amplifier AMPb. In a common error amplifier, a random offset voltage occurring during a manufacturing process is on the order of ±15 mV. As a result, in consideration of a margin to the random offset, the offset voltage of the second error amplifier AMPb should be set on the order of 20 mV. When the random offset occurring during the manufacturing process is +15 mV for example, it is added to the previously set offset voltage and thus, the total offset amounts to 35 mV.

Further, variations in electric characteristics occur in the manufacturing processes in all devices included in the constant voltage circuit. As a result, the response characteristics may degrade twice accordingly. As a result, even if the second error amplifier AMPb has superior response, the second error amplifier AMPb may not respond until a voltage change in the output voltage amounts to 35 mV×2=70 mV, because of the above-mentioned variations in the manufacturing processes.

For example, assuming a logic circuit manufactured with a fine process not more than 90 nm, as a load of a constant voltage circuit for which high speed response is required, it is expected that the guaranteed operation voltage range may be 1 V±50 mV. In this case, it may be clearly seen that the response characteristics may not be sufficient in the second method. Further, although it is possible to correct the above-mentioned variations occurring in the manufacturing processes by means of trimming, a chip size may increase and also, a test process may increase as a result of a trimming device being disposed. Accordingly, the cost may increase.

In the above-mentioned third method, when the power source voltage lowers due to a steep increase in the load electric current, respective gate voltages of the two NMOS transistors having different threshold voltages are lowered via the capacitor, and the transistor having the large threshold is turned off. As a result, a drain voltage of the transistor increases. Response is improved as a result of an operation electric current being increased in response to the increase in the drain voltage. However, the operation electric current increases after the change level in the power source voltage reaches the voltage difference of the threshold voltage. Accordingly, the problem same as that in the second method may be involved.

DISCLOSURE OF THE INVENTION

The present invention has been devised in consideration of these problems, and an object of the present invention is to provide a constant voltage circuit in which, a cost increase due to an increase in a chip size and/or an increase in a test process is avoided, a response speed is improved with a reduced electric current consumption, and a change in an output voltage can be remarkably reduced.

According to the present invention, a constant voltage circuit converting an input voltage input from an input terminal into a predetermined constant voltage and outputting the same from an output terminal, has:

an output transistor outputting an electric current according to an input control signal from the input terminal, to the output terminal;

a control circuit part having a first error amplifying circuit carrying out operation control of the output transistor in such a manner that the a first proportional voltage proportional to the output voltage output from the output terminal may be a predetermined first reference voltage;

a voltage change detecting circuit part detecting a change of the output voltage output from the output terminal, and amplifying an output signal of a differential amplifying circuit included in the first error amplifying circuit, converting the same into a binary signal and outputting the binary signal; and a discharging circuit part amplifying a discharge electric current for a capacitance parasitic on a control electrode of the output transistor, according to an output voltage from the voltage change detecting circuit part, wherein:

the voltage change detecting circuit part amplifies the output signal of the differential amplifying circuit so that a slew rate thereof may be larger than that of the control signal output from the first error amplifying circuit to the output transistor, responds to a change of the output voltage output from the output terminal quicker than the control signal output from the first error amplifying circuit to the output transistor, to cause the discharging circuit part to carry out discharging operation.

In the present invention, it is possible to instantaneously detect slight reduction in the output voltage and thus it is possible to improve a response for controlling the output transistor. Accordingly, it is possible to remarkably reduce reduction in the output voltage occurring due to a steep change in the output electric current. Further, the response for controlling the output transistor is improved only when the output voltage changes due to a steep change in the output electric current. Thus, it is not necessary to constantly increase an electric current consumption as in the prior art for the purpose of improving the response. Thus, even as the constant voltage circuit used in a portable device or such, it is possible to obtain a high speed response with a reduced electric current consumption.

BRIEF DESCRIPTION OF DRAWINGS

Other objects and further features of the present invention will become more apparent from the following detailed description when read in conjunction with the accompanying drawings.

BEST MODE FOR CARRYING OUT THE PRESENT INVENTION

Figure 1:
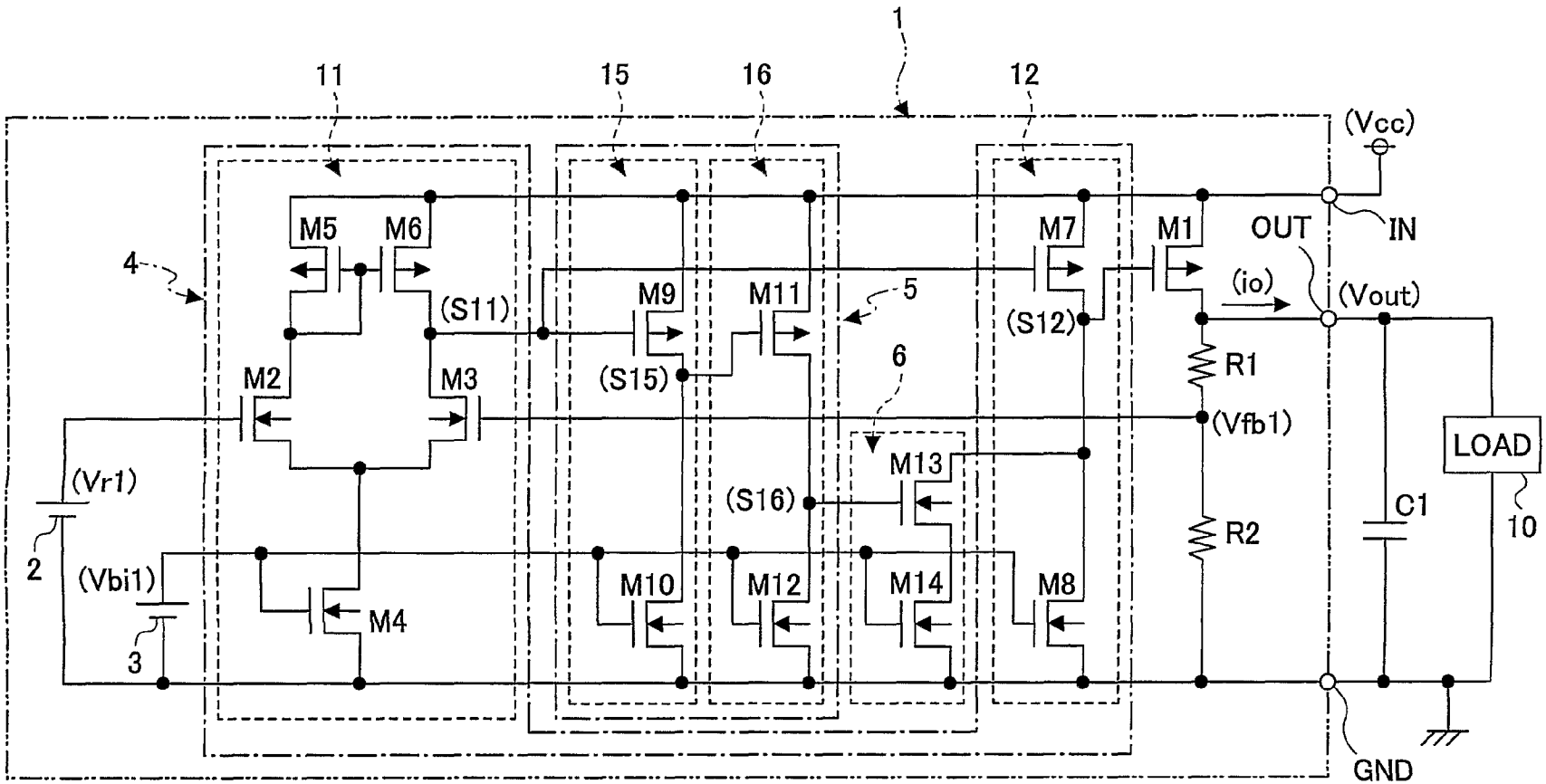
FIG. 1 shows an example of a configuration of a constant voltage circuit in a first embodiment of the present invention.

According to an embodiment of the present invention, a constant voltage circuit converting an input voltage input from an input terminal into a predetermined constant voltage and outputting the same from an output terminal, has:

an output transistor outputting an electric current according to an input control signal from the input terminal, to the output terminal;

a control circuit part having a first error amplifying circuit carrying out operation control of the output transistor in such a manner that the a first proportional voltage proportional to the output voltage output from the output terminal may be a predetermined first reference voltage;

a voltage change detecting circuit part detecting a change of the output voltage output from the output terminal, and amplifying an output signal of a differential amplifying circuit included in the first error amplifying circuit, converting the same into a binary signal and outputting the binary signal; and a discharging circuit part amplifying a discharge electric current for discharging a capacitance parasitic on a control electrode of the output transistor, according to an output voltage from the voltage change detecting circuit part, wherein:

the voltage change detecting circuit part amplifies the output signal of the differential amplifying circuit so that a slew rate thereof may be larger than that of the control signal output from the first error amplifying circuit to the output transistor, responds to a change of the output voltage output from the output terminal quicker than the control signal output from the first error amplifying circuit to the first transistor, to cause the discharging circuit part to carry out discharging operation.

Specifically, the voltage change detecting circuit part has:

a second amplifying circuit amplifying the output signal of the differential amplifying circuit and outputting the amplified signal; and a third amplifying circuit amplifying the output signal of the second amplifying circuit, converting the amplified signal into a binary signal and outputting the binary signal to the discharging circuit part, wherein:

the second amplifying circuit has a slew rate of the output signal larger than that of the output signal of the first error amplifying circuit.

Further, the first error amplifying circuit has:

a differential amplifying part amplifying a voltage difference between the first proportional voltage and the first reference voltage, and outputting the amplified signal; and a first amplifying circuit amplifying an output signal of the differential amplifying circuit, and outputting the amplified signal to the control electrode of the output transistor, wherein:

the second amplifying circuit has a larger voltage gain than that of the first amplifying circuit.

Further, the first amplifying circuit may have:

a first transistor as a voltage amplifying device, the output signal of the differential amplifying circuit being input to a control electrode thereof; and a first electric current source providing a first bias electric current to the first transistor, wherein:

the second amplifying circuit may have:

a second transistor as a voltage amplifying device, the output signal of the differential amplifying circuit being input to a control electrode thereof; and a second electric current source providing a second bias electric current, smaller than the first bias electric current, to the second transistor.

Further, the first amplifying circuit may have:

a first transistor as a voltage amplifying device, the output signal of the differential amplifying circuit being input to a control electrode thereof; and a first electric current source providing a first bias electric current to the first transistor, wherein:

the second amplifying circuit may have:

a second transistor as a voltage amplifying device, the output signal of the differential amplifying circuit being input to a control electrode thereof, the second transistor has an electric current driving capability larger than that of the first transistor; and a second electric current source providing a second bias electric current to the second transistor.

Further, the third amplifying circuit comprises:

a third transistor as a voltage amplifying device, the output signal of the second amplifying circuit being input to a control electrode thereof; and a third electric current source providing a third bias electric current to the third transistor, wherein:

the third amplifying circuit has a parasitic capacitance of the control electrode smaller than that of the output transistor.

Specifically, the discharging circuit part has:

a fourth electric current source for discharging the capacitance of the control electrode of the output transistor; and a first switching device carrying out control of connecting between the control electrode of the output transistor and the fourth electric current source, according to the output signal of the voltage change detecting circuit part.

Further, the discharging circuit part may have:

a fifth electric current source for increasing a bias electric current to be supplied to a differential pair of the differential amplifying circuit; and a second switching device carrying out control of connecting between the differential amplifying circuit and the fifth electric current source, according to the output signal of the voltage change detecting circuit part, wherein:

the second switching device may carry out the same connecting operation as that of the first switching device.

Further, the first error amplifying circuit may have a differential amplifying circuit amplifying a voltage difference between the first proportional voltage and the first reference voltage, and outputting the amplified signal, wherein a first signal output from a first output end which is one output end of the differential amplifying circuit may be input to the control electrode of the output transistor, and a second signal output from a second output end which is another output end of the differential amplifying circuit may be output to the second amplifying circuit of the voltage change detecting circuit part.

Further, the second amplifying circuit has a slew rate of the output signal larger than that of the first signal of the differential amplifying circuit.

Further, the differential amplifying circuit has:

a first input transistor, the first reference voltage being input to a control electrode thereof;

a second input transistor, the first proportional voltage being input to a control electrode thereof;

a first load circuit acting as a load of the first input transistor;

a second load circuit acting as a load of the second input transistor; and a bias electric current source supplying a bias electric current to the first input transistor and the second input transistor, wherein:

the first signal is output from a connection point between the first input transistor and the first load circuit, and the second signal is output from a connection point between the second input transistor and the second load circuit.

Further, the second amplifying circuit has a voltage gain larger than a voltage gain determined by the first input transistor, the first load circuit and the bias electric current source.

Specifically, the second amplifying circuit has:

a second transistor acting as a voltage amplifying device, the output signal of the differential amplifying circuit being input to a control electrode thereof; and a second electric current source supplying a second bias electric current to the second transistor, wherein:

the first load circuit and the second load circuit configure a current-mirror circuit in which the second load circuit acts as an input-side transistor and the first load circuit acts as an output-side transistor; and the second transistor has an electric current driving capability larger than that of the transistor acting as the first load circuit.

Further, the discharging circuit part has:

a fourth electric current source for increasing a bias electric current supplied to the first input transistor and the second input transistor of the differential amplifying circuit;

a first switching device carrying out control of connecting between the differential amplifying circuit and the fourth electric current source, according to the output signal of the voltage change detecting circuit part.

In this case, the fourth electric current source supplies an electric current smaller than that of the bias electric current source.

On the other hand, the discharging circuit part has:

a second error amplifying circuit carrying out control of operation of the output transistor in such a manner that a second proportional voltage proportional to the output voltage output from the output terminal may be a predetermined second reference voltage, the second error amplifying circuit having a response speed higher than that of the first error amplifying circuit; and a switching circuit carrying out control of connecting between an output end of the second error amplifying circuit and the control electrode of the output transistor, according to the output signal of the voltage change detecting circuit part, wherein:

the voltage change detecting circuit part responds to a change of the output voltage output from the output terminal quicker than that of the control signal output to the output transistor from the first error amplifying circuit, to control the switching circuit so as to connect the output end of the second error amplifying circuit to the control electrode of the output transistor.

In this case, the first error amplifying circuit has an electric current consumption smaller than that of the second error amplifying circuit.

Further, the discharging circuit part has:

an output electric current detecting circuit detecting a value of an electric current output from the output transistor, and outputting a predetermined signal when the thus-detected electric current value becomes not less than a predetermined value; and a switching control circuit carrying out control of operation of the switching circuit, according to the respective output signals of the voltage change detecting circuit part and the output electric current detecting circuit, wherein:

the switching control circuit causes the switching circuit to connect the output end of the second error amplifying circuit to the control electrode of the output transistor, when the signal from the voltage change detecting circuit part indicating that the output end of the second error amplifying circuit is connected to the control electrode of the output transistor and/or the signal from the output electric current detecting circuit indicating that the detected electric current becomes not less than the predetermined value is input.

Further, the discharging circuit part has:

a second output voltage detecting circuit generating and outputting the second proportional voltage; and a second reference voltage generating circuit generating and outputting the second reference voltage, wherein:

the second error amplifying circuit, the second output voltage detecting circuit and the second reference voltage generating circuit stop their operations respectively, when the signal breaking the connection between the output end of the second error amplifying circuit and the control electrode of the output transistor is output to the switching circuit from the switching control circuit, so that an electric current consumption is reduced.

Further, the second proportional voltage may be equal to the first proportional voltage.

Further, the second reference voltage may be equal to the first reference voltage.

Further, the output transistor, the control circuit part, the voltage change detecting circuit part and the discharging circuit part may be integrated in a single integrated circuit.

In the embodiment of the present invention, it is possible to instantaneously detect slight reduction in the output voltage and thus it is possible to improve a response for controlling the output transistor. Accordingly, it is possible to remarkably reduce reduction in the output voltage occurring due to a steep change in the output electric current. Further, the response for controlling the output transistor is thus improved only when the output voltage changes due to a steep change in the output electric current. As a result, it is not necessary to constantly increase an electric current consumption as in the prior art for the purpose of improving the response. Thus, even as the constant voltage circuit used in a portable device or such, it is possible to obtain a high speed response with a reduced electric current consumption.

Next, based on embodiments shown in figures, the present invention will be described in more detail.

First Embodiment

FIG. 1 shows an example of a configuration of a constant voltage circuit in a first embodiment of the present invention.

In FIG. 1, the constant voltage circuit 1 generates a predetermined constant voltage from an input voltage Vcc input to an input terminal IN, and outputs an output voltage Vout from an output terminal OUT to a load 10. Between the output terminal OUT and a ground voltage, a capacitor C1 is connected. It is noted that, the constant voltage circuit 1 may be integrated into an IC (Integrated Circuit).

The constant voltage circuit 1 includes a reference voltage generating circuit 2 generating and outputting a predetermined reference voltage Vr1; a bias voltage generating circuit 3 generating and outputting a predetermined bias voltage Vbi1; resistors R1, R2 for detecting the output voltage by dividing the output voltage Vout to generate and output a divided voltage Vfb1; an output transistor M1, i.e., a PMOS transistor carrying out control of an electric current io to be output to the output terminal OUT according to a signal input to a gate thereof; and an error amplifying circuit 4 carrying out control of operation of the output transistor M1 in such a manner that the divided voltage Vfb1 may be the reference voltage Vr1. Further, the constant voltage circuit 1 includes a voltage change detecting circuit 5 detecting a change in the output voltage Vout; and an output voltage returning circuit 6 returning the output voltage Vout to the predetermined voltage by increasing a discharging electric current to discharge a gate capacitance of the output transistor M1.

Further, the error amplifying circuit 4 includes a differential amplifying circuit 11 amplifying a voltage difference between the reference voltage Vr1 and the divided voltage Vfb1 and outputting the amplified signal; and a first amplifying circuit 12 amplifying the output signal of the differential amplifying circuit 11 and outputting the amplified signal, a source of which is grounded. The voltage change detecting circuit 5 includes a second amplifying circuit 15 amplifying the output signal of the differential amplifying circuit and outputting the amplified signal, a source of which is grounded; and a third amplifying circuit 16 amplifying the output signal of the second amplifying circuit 15 and outputting the amplified signal to the output voltage returning circuit 6, a source of which is grounded. It is noted that the reference voltage generating circuit 2, the resistors R1, R2 and the error amplifying circuit 4 act as the above-mentioned control circuit part; the error amplifying circuit 4 acts as the above-mentioned first error amplifying circuit; the voltage change detecting circuit 5 acts as the above-mentioned voltage change detecting circuit part; and the output voltage returning circuit 6 acts as the above-mentioned discharging circuit part. Further, the divided voltage Vfb1 acts as the above-mentioned first proportional voltage; and the reference voltage Vr1 acts as the above-mentioned first reference voltage.

The differential amplifying circuit 11 includes NMOS transistors M2 through M4 and PMOS transistors M5, M6. The NMOS transistors M2 and M3 act as a differential pair, and the PMOS transistors M5 and M6 acting as a load of the differential pair configure a current-mirror circuit. The first amplifying circuit 12 includes a PMOS transistor M7 and an NMOS transistor MB, connected in series between the input voltage Vcc and the ground voltage. Similarly, the second amplifying circuit 15 includes a PMOS transistor M9 and an NMOS transistor M10, connected in series between the input voltage Vcc and the ground voltage; and the third amplifying circuit 16 includes a PMOS transistor M11 and an NMOS transistor M12, connected in series between the input voltage Vcc and the ground voltage. Further, the output voltage returning circuit 6 includes NMOS transistors M13 and M14.

In the differential amplifying circuit 11, respective sources of the NMOS transistors M2 and M3 acting as the differential pair are connected together, and the NMOS transistor M4 is connected between the connection point and the ground voltage. To a gate of the NMOS transistor M4, a bias voltage Vbi1 is input, and the NMOS transistor M4 acts as a constant electric current source. Respective gates of the PMOS transistors M5 and M6 are connected together, and the connection point is connected to a drain of the PMOS transistor M5. The drain of the PMOS transistor M5 is connected to a drain of the NMOS transistor M2, and a drain of the PMOS transistor M6 is connected to a drain of the NMOS transistor M3. To each of respective sources of the PMOS transistors M5 and M6, the input voltage Vcc is input. A gate of the NMOS transistor M2 acts as an inverted input terminal the differential amplifying circuit 11, and the reference voltage Vr1 is input thereto. A gate of the NMOS transistor M3 acts as a non-inverted input terminal of the differential amplifying circuit 11, and the divided voltage Vfb1 is input thereto. Further, the connection point between the PMOS transistor M6 and the NMOS transistor M3 acts as an output end of the differential amplifying circuit 11, and is connected to each of respective gates of the PMOS transistors M7 and M9.

Next, in the first amplifying circuit 12, to a gate of the NMOS transistor M8, the bias voltage Vbi1 is input, and the NMOS transistor M8 acts as a constant electric current source. A connection point between the PMOS transistor M7 and the NMOS transistor M8 is connected to a gate of the output transistor M1.

Similarly, in the second amplifying circuit 15, to a gate of the NMOS transistor M10, the bias voltage Vbi1 is input, and the NMOS transistor M10 acts as a constant electric current source. A connection point between the PMOS transistor M9 and the NMOS transistor M10 is connected to a gate of the PMOS transistor M11.

In the third amplifying circuit 16, to a gate of the NMOS transistor M12, the bias voltage Vbi1 is input, and the NMOS transistor M12 acts as a constant electric current source. A connection point between the PMOS transistor M11 and the NMOS transistor M12 is connected to a gate of the NMOS transistor M13.

In the output voltage returning circuit 6, between a gate of the output transistor M1 and the ground voltage, the NMOS transistors M13 and M14 are connected in series, the bias voltage Vbi1 is input to a gate of the NMOS transistor M14, and the NMOS transistor M14 acts as a constant electric current source.

It is noted that the PMOS transistor M7 acts as the above-mentioned first transistor; the NMOS transistor M8 acts as the above-mentioned first electric current source; the PMOS transistor M9 acts as the above-mentioned second transistor; the NMOS transistor M10 acts as the above-mentioned second electric current source; the PMOS transistor M11 acts as the above-mentioned third transistor; and the NMOS transistor M12 acts as the above-mentioned third electric current source. Further, the NMOS transistor M13 acts as the above-mentioned first switching device; and the NMOS transistor M14 acts as the above-mentioned fourth electric current source.

In the configuration, the PMOS transistor M11 as an input transistor of the third amplifying circuit 16 has a size much smaller than that of the output transistor M1, and has a gate capacitance much smaller than that of the output transistor M1. Since an output load of the second amplifying circuit 15 corresponds to the third amplifying circuit 16, the input capacitance is very small, and, a voltage of a connection point between the drain of the PMOS transistor M9 and the drain of the NMOS transistor M10, which is an output end of the second amplifying circuit 15, can change rapidly according to a change in an output signal S11 of the differential amplifying circuit 11. That is, a slew rate of an output signal S15 of the second amplifying circuit 15 is much larger than a slew rate of an output signal S12 of the first amplifying circuit 12.

As a result, when the output voltage Vout lowers due to a steep increase of the output electric current io, the output signal S15 of the second amplifying circuit 15 changes before the output signal S12 of the first amplifying circuit 12 changes to increase the output electric current of the output transistor M1, and, by means of an output signal S16 of the third amplifying circuit 16 acting as a control signal for carrying out control of operation of the output voltage returning circuit 6, the NMOS transistor M13 is turned on, and thus, is made to enter an electric conduction state. As a result, the NMOS transistor M14 acting as the constant electric current source is connected to the gate of the output transistor M1, and the gate capacitance of the output transistor M1 is rapidly discharged. As a result, the electric current output from the output transistor M1 increases and the output voltage Vout of the output transistor M1 returns to the predetermined voltage.

It is noted that a voltage gain of the second amplifying circuit 15 is set as being larger than a voltage gain of the first amplifying circuit 12, and, when voltages having the equal values are input thereto respectively, the output voltage of the second amplifying circuit 15 becomes larger than the output voltage of the first amplifying circuit 12. In order to achieve the voltage gain of the second amplifying circuit 15 to be thus larger than the voltage gain of the first amplifying circuit 12, for example, the second bias electric current supplied by the NMOS transistor M10 acting as the constant electric current source is made smaller than the first bias electric current supplied by the NMOS transistor M8 also acting as the constant electric current source, or, the PMOS transistor M9 is made to have an electric current driving capability larger than that of the PMOS transistor M7.

Figure 2:
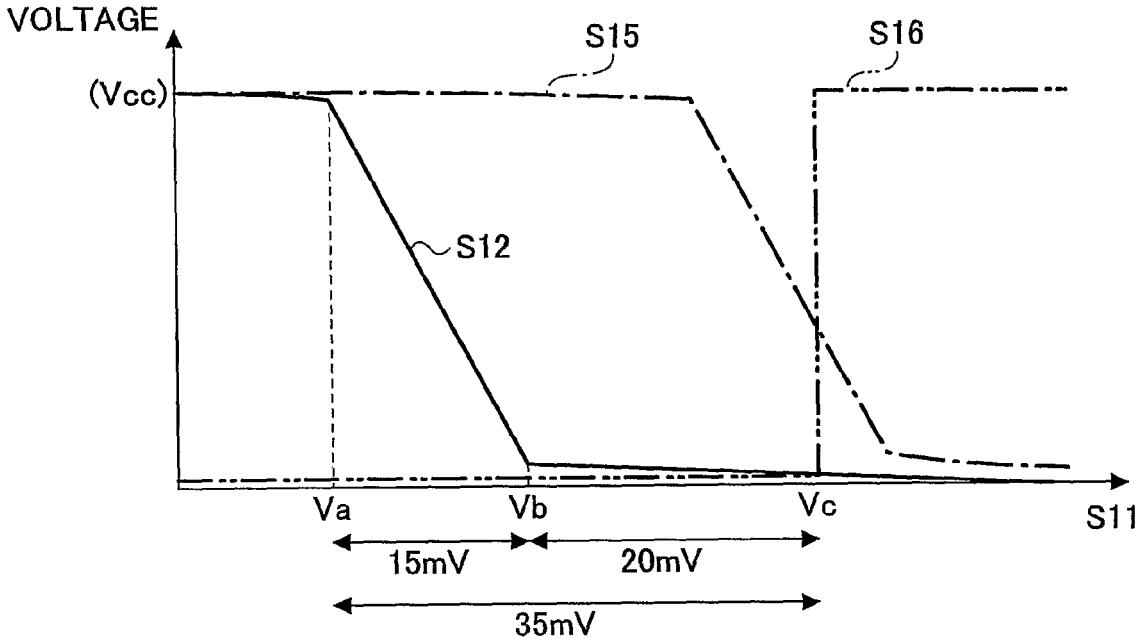
FIG. 2 shows a relationship among an output signal of a differential amplifying circuit, and respective output signals of a first amplifying circuit 12, a second amplifying circuit 15 and a third amplifying circuit 16.

FIG. 2 shows an example of a relationship among the output signal S11 of the differential amplifying circuit 11, and the respective output signals S12, S15 and S16 of the first amplifying circuit 12, the second amplifying circuit 15 and the third amplifying circuit 16. It is note that, in FIG. 2, a solid line represents the output signal S12 of the first amplifying circuit 12, a chain line represents the output signal S15 of the second amplifying circuit 15 and a chain double-dashed line represents the output signal S16 of the third amplifying circuit 16.

The output signal S12 of the first amplifying circuit 12 changes from the power source voltage Vcc to approximately 0 V according to the load current io, and controls the electric current output from the output transistor M1. That is, in all the load conditions, the output signal S11 of the differential amplifying circuit 11 changes from Va to Vb. At this time, the output signal S15 of the second amplifying circuit 15 does not change from the power source voltage Vcc, and also the output signal S16 of the third amplifying circuit 16 does not change from 0 V. Accordingly, the NMOS transistor M13 of the output voltage returning circuit 6 stays in a turned off state at any time.

Next, in order that the NMOS transistor M13 of the output voltage returning circuit 6 is turned on, the voltage of the output signal S15 of the second amplifying circuit 15 should lower and the output signal S16 of the third amplifying circuit 16 should change from 0 V to the power source voltage Vcc. That is, in FIG. 2, when the load current io is small, the voltage of the output signal S11 should be Va, and, the voltage of the output signal S11 of the differential amplifying circuit 11 should increase from Va to Vc by increasing by 35 mV.

In order that the output signal S11 of the differential amplifying circuit 11 increases by 35 mV, the divided voltage Vfb1 should change by 35 mV/30 dB=1.1 mV, assuming that the voltage gain of the differential amplifying circuit 11 is 30 dB. Converging it to a change in the output voltage Vout, 1.1 mV×(r1+r2)/r2=2.2 mV is obtained, assuming that resistance values of the resistors R1 and R1 are r1 and r2, and (r1+r2)/r2=2. That is, in this case, reduction of the output voltage Vout merely by 2.2 mV is detected, the NMOS transistor M13 of the output voltage returning circuit 6 is thus turned on, and the gate capacitance of the output transistor M1 is rapidly discharged. Further, the second amplifying circuit 15 has the voltage gain larger than that of the first amplifying circuit 12, and the input voltage required for lowering the output voltage in the second amplifying circuit 15 is larger than that in the first amplifying circuit 12. Such a difference in the input voltages acts as an offset voltage between the first amplifying circuit 12 and the second amplifying circuit 15. When a difference between Vc and Vb is positive, the NMOS transistor M13 is not turned on when no reduction in the output voltage Vout due to a steep increase of the load electric current io occurs.

In a case where such an offset voltage is set, the offset voltage is set as being 20 mV considering a margin to a random offset voltage, assuming that the random offset voltage occurring during a manufacturing process is ±15 mV for example. In this case, when the random offset voltage is actually +15 mV during the manufacturing process, a difference between Vc and Va becomes the maximum value, i.e., 50 mV. Converting it into a change in the output voltage Vout, 50 mV/30 dB×(r1+r2)/r2=3.1 mV is obtained. That is, a variation in the offset voltage is thus attenuated by the voltage gain of the error amplifying circuit 4, and thus, an influence thereof is very small.

Thus, in a steady state in which the load current is small, the output voltage of the second amplifying circuit 15 is the input voltage Vcc which is the power source voltage, the third amplifying circuit 16 outputs the signal of the ground voltage, and the NMOS transistor M13 of the output voltage returning circuit 6 is turned off. When the load current io steeply increases and the output voltage Vout lowers, the output voltage of the second amplifying circuit 15 lowers to the ground voltage, the output voltage of the third amplifying circuit 16 becomes the input voltage Vcc, and the NMOS transistor M13 of the output voltage returning circuit 6 is turned on to enter an electrical conduction state.

Thus, the output voltage returning circuit 6 operates to discharge the capacitance of the gate electrode of the output transistor M1 and increase the electric current of the output transistor M1, only from a slight change in the output voltage Vout. Thus, it is possible to instantaneously return from the reduction in the output voltage Vout. Further, since the above-mentioned variations in the offset voltage are attenuated by the voltage gain of the error amplifying circuit 4, the influence thereof is very small. Further, when no steep reduction of the output voltage Vout occurs, the output voltage returning circuit 6 does not operate, and thus, during the normal state, it does not affect operation of the differential amplifying circuit 11, the first amplifying circuit 12 and the output transistor M1. Accordingly, it is possible to provide the constant voltage circuit which can carry out high speed response with a reduced electric current consumption.

Second Embodiment

Generally speaking, when a differential amplifying circuit is designed, in order to reduce an input offset voltage, for example it is necessary to make drain electric currents of the NMOS transistors M2 and M3 in the differential amplifying circuit 11 equal. Since the drain electric currents of the NMOS transistors M2 and M3 are determined by the PMOS transistors M5 and M6, the PMOS transistors M5 and M6 are to be formed in such a manner that the same devices are used to have the same sizes. Then, since respective sources are connected and also respective gates are connected in the PMOS transistors M5 and M6, when the drain voltages of the PMOS transistors M5 and M6 are thus designed to be equal, the drain electric currents of the PMOS transistors M5 and M6 become equal accordingly, and thus, the drain electric currents of the NMOS transistors M2 and M3 become equal accordingly.

There, the drain-to-source voltage of the PMOS transistor M5 is equal to the gate-to-source voltage of the PMOS transistor M5, and also, the drain-to-source voltage of the PMOS transistor M6 is equal to the gate-to-source voltage of the PMOS transistor M7. Accordingly, such a configuration should be provided that the gate-to-source voltage of the PMOS transistor M5 may be equal to the gate-to-source voltage of the PMOS transistor M7.

For this purpose, such a configuration should be provided that, when the output voltage Vout steeply lowers, the bias current of not only the PMOS transistor M7 but also of the PMOS transistor M5 should be increased. The second embodiment of the present invention has such a configuration.

Figure 3:
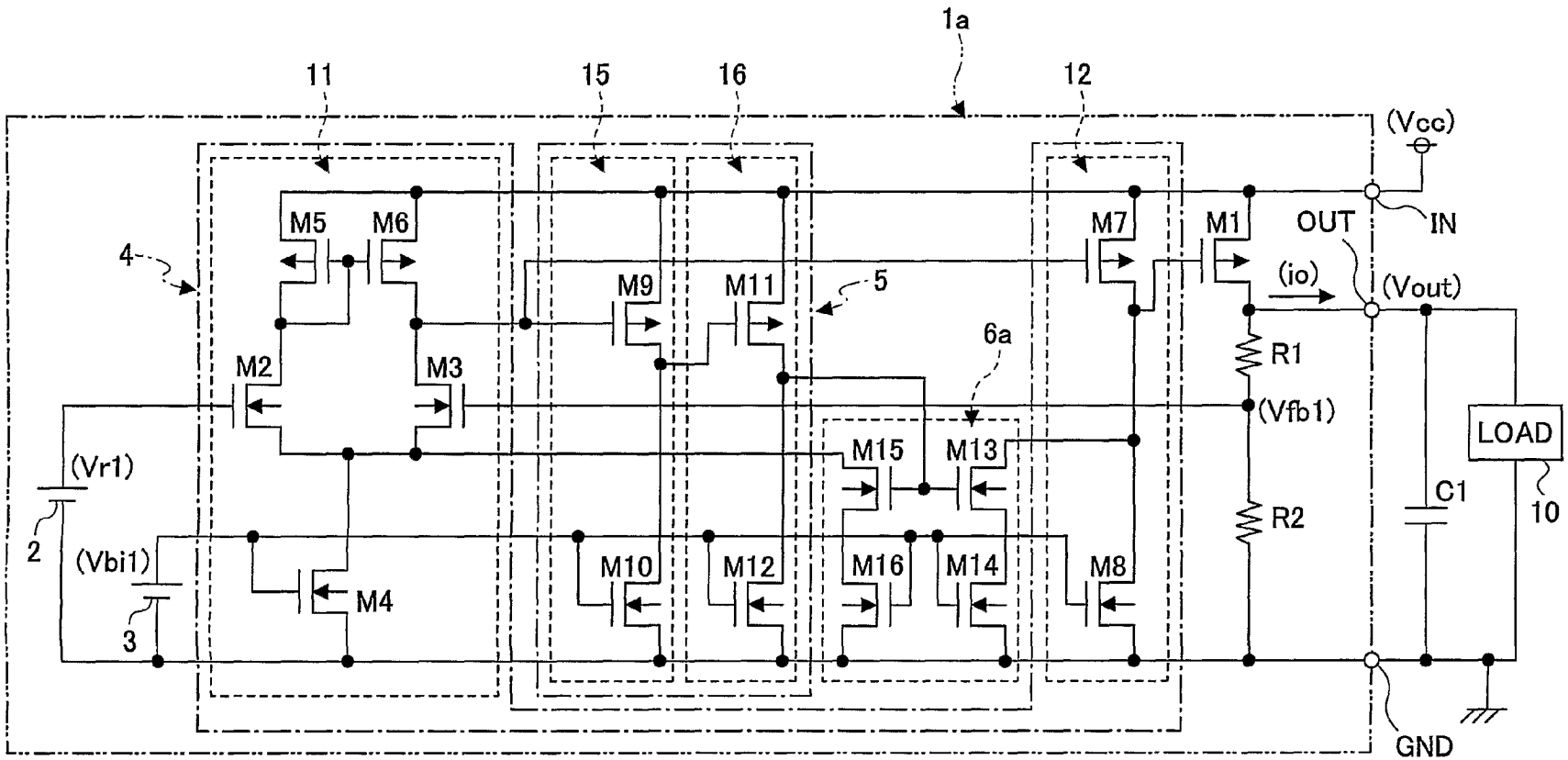
FIG. 3 shows an example of a configuration of a constant voltage circuit in a second embodiment of the present invention.

FIG. 3 shows an example of a configuration of a constant voltage circuit in the second embodiment of the present invention. It is noted that, in FIG. 3, the same reference numerals are given to devices the same as those in FIG. 1, the duplicate description will be omitted and, only points different from FIG. 1 will be described.

The different points in FIG. 3 from FIG. 1 are that, the output voltage returning circuit 6 has NMOS transistors M15 and M16 added, and based thereon, the output voltage returning circuit 6 in FIG. 1 is changed into an output voltage returning circuit 6*a*, and also, the constant voltage circuit 1 in FIG. 1 is changed onto a constant voltage circuit 1*a*.

In FIG. 3, the constant voltage circuit 1*a* generates a predetermined constant voltage from an input voltage Vcc input to an input terminal IN, and outputs the predetermined constant voltage as an output voltage. Vout to a load 10 from an output terminal OUT. It is noted that, the constant voltage circuit 1*a* may be integrated in to a single IC (Integrated Circuit).

The constant voltage circuit 1*a* includes a reference voltage generating circuit 2, a bias voltage generating circuit 3, resistors R1, R2, an error amplifying circuit 4, a voltage change detecting circuit 5, an output voltage returning circuit 6*a* discharging a gate capacitance of an output transistor M1 and returning the output voltage Vout to the predetermined voltage.

The output voltage returning circuit 6*a* has NMOS transistors M13 through M16. A series circuit of the NMOS transistors M15 and M16 is connected with the NMOS transistor M4 in parallel, a gate of the NMOS transistor M15 is connected to a gate of the NMOS transistor M13, the NMOS transistor M16 has a bias voltage Vbi1 input to a gate thereof so as to act as a constant electric current source. It is noted that, the output voltage returning circuit 6*a* acts as the above-mentioned discharging circuit part, the NMOS transistor M15 acts as the above-mentioned second switching device and the NMOS transistor M16 acts as the above-mentioned fifth electric current source.

By configuring so, when steep reduction of the output voltage Vout occurs, the bias current of not only the PMOS transistor M7 but also of the PMOS transistor M5 can be increased, and, when the output voltage returning circuit 6*a* operates, the gate-to-source voltage of the PMOS transistor M5 and the gate-to-source voltage of the PMOS transistor M7 come to be equal at any time. Thus, it is possible to reduce a change in the output voltage Vout due to the input offset voltage occurring in the differential amplifying circuit 11.

Third Embodiment

In the above-mentioned first embodiment, the error amplifying circuit 4 includes the differential amplifying circuit 11 and the first amplifying circuit 12. However, the error amplifying circuit 4 may only include the differential amplifying circuit 11. The third embodiment of the present invention has such a configuration.

Figure 4:
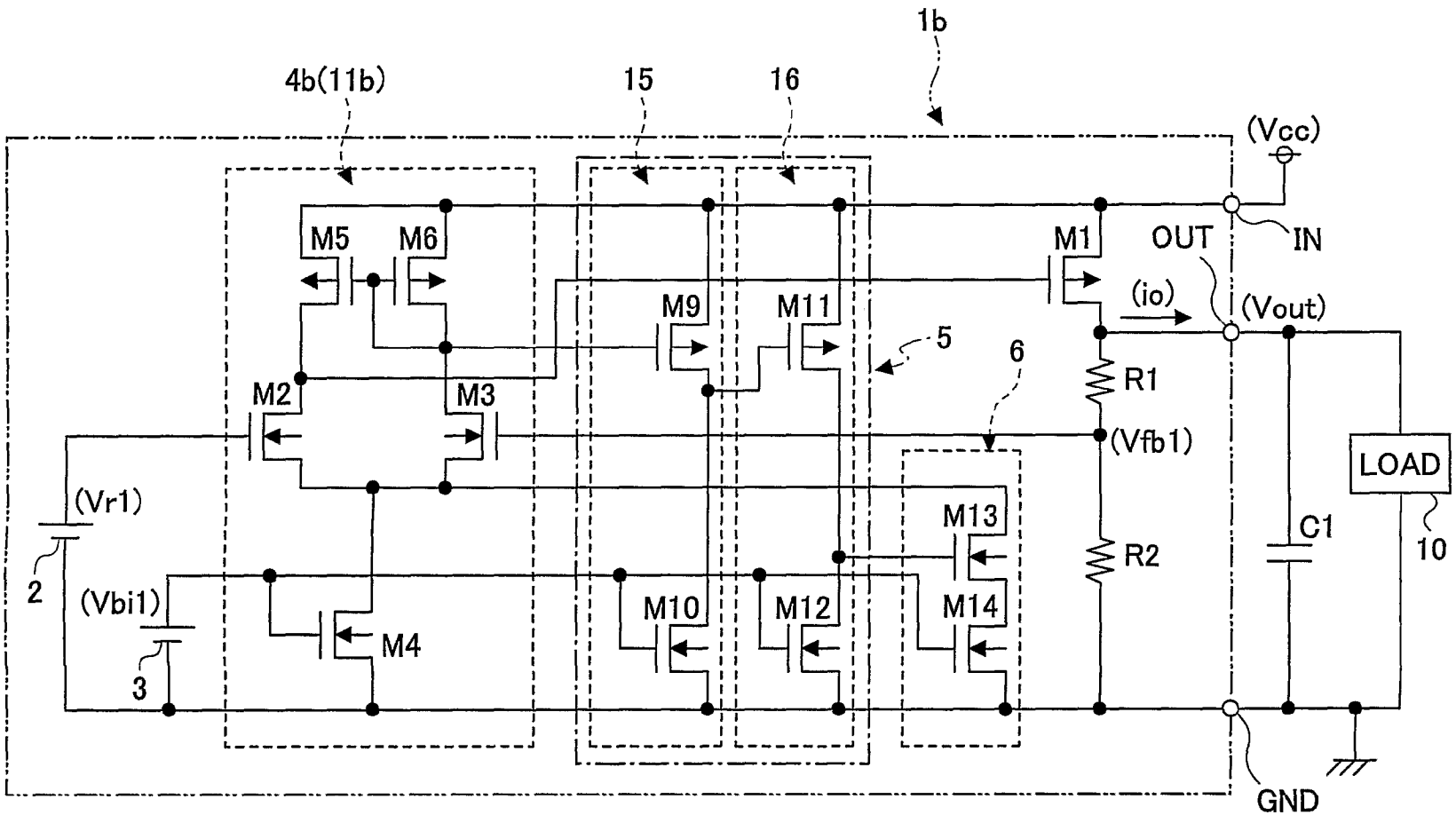
FIG. 4 shows an example of a configuration of a constant voltage circuit in a third embodiment of the present invention.

FIG. 4 shows an example of a configuration of a constant voltage circuit in the third embodiment of the present invention. It is noted that, in FIG. 4, the same reference numerals are given to devices the same as those in FIG. 1, the duplicate description will be omitted and, only points different from FIG. 1 will be described.

The different points in FIG. 4 from FIG. 1 are that the first amplifying circuit 12 is removed, and, in the differential amplifying circuit 11, the connection point between the respective gates of the PMOS transistors M5 and M6 is connected to the drain of the PMOS transistor M6, the gate of the output transistor M1 is connected with the drain of the NMOS transistor M2, the gate of the PMOS transistor M9 is connected with the drain of the NMOS transistor M3, and further, the output voltage returning circuit 6 is connected to the NMOS transistor M4 in parallel. Based thereon, the differential amplifying circuit 11 of FIG. 1 is changed into a differential amplifying circuit 11*b*, the error amplifying circuit 4 is changed into an error amplifying circuit 4*b*, and the constant voltage circuit 1 in FIG. 1 is changed into a constant voltage circuit 1*b*.

In FIG. 4, the constant voltage circuit 1*b* generates a predetermined constant voltage from an input voltage Vcc input to an input terminal IN, and outputs the predetermined constant voltage an output voltage Vout to a load 10 from an output terminal OUT. It is noted that, the constant voltage circuit 1*b* may be integrated in to a single IC (Integrated Circuit).

The constant voltage circuit 1*b* includes a reference voltage generating circuit 2, a bias voltage generating circuit 3, resistors R1, R2, an output transistor M1, an error amplifying circuit 4*b* carrying out control of operation of the output transistor M1 in such a manner that a divided voltage Vfb1 may be a reference voltage Vr1, a voltage change detecting circuit 5 and an output voltage returning circuit 6.

Further, the error amplifying circuit 4*b* includes a differential amplifying circuit 11*b* amplifying a voltage difference between the reference voltage Vr1 and the divided voltage Vfb1 and outputting the amplified signal. The voltage change detecting circuit 5 includes a second amplifying circuit 15 amplifying the output signal of the differential amplifying circuit 11*b* and outputting the amplified signal, a source of which is grounded; and a third amplifying circuit 16 amplifying the output signal of the second amplifying circuit 15 and outputting the amplified signal to the output voltage returning circuit 6, a source of which is grounded. It is noted that the error amplifying circuit 4*b* acts as the above-mentioned first error amplifying circuit.

The differential amplifying circuit 11*b* includes NMOS transistors M2 through M4 and PMOS transistors M5, M6. The NMOS transistors M2 and M3 act as a differential pair, and the PMOS transistors M5 and M6 acting as a load of the differential pair configure a current-mirror circuit. The connection point between the PMOS transistor M5 and the NMOS transistor M2 acts as one output end of the differential amplifying circuit 11*b* and acts as the above-mentioned first output end, and is connected to a gate of the output transistor M1. The connection point between the PMOS transistor M6 and the NMOS transistor M3 acts as another output end of the differential amplifying circuit 11*b* and acts as the above-mentioned second output end, and is connected to a gate of the PMOS transistor M9.

In the output voltage returning circuit 6, a series circuit of NMOS transistors M13 and M14 is connected to the NMOS transistor M4 in parallel, a bias voltage Vbi1 is input to a gate of the NMOS transistor M14, and the NMOS transistor M14 acts as a constant electric current source.

It is noted that the NMOS transistor M2 acts as the above-mentioned first input transistor, the NMOS transistor M3 acts as the above-mentioned second input transistor, the PMOS transistor M5 acts as the above-mentioned first load circuit, the PMOS transistor M6 acts as the above-mentioned second load circuit, and the NMOS transistor M4 acts as the above-mentioned bias electric current source.

In the configuration, the PMOS transistor M11 as an input transistor of the third amplifying circuit 16 has a size much smaller than that of the output transistor M1, and also, has a gate input capacitance much smaller than that of the output transistor M1. Since an output load of the second amplifying circuit 15 is the third amplifying circuit 16, the input capacitance is thus very small, and, thus, the voltage at the connection point between the drain of the PMOS transistor M9 and the drain of the NMOS transistor M10 which acts as an output end of the second amplifying circuit 15 can change at high speed according to a change in the output signal of the differential amplifying circuit 11*b*. That is, a slew rate of the output signal of the second amplifying circuit 15 is much larger than a slew rate of a signal output to the gate of the output transistor M1 from the differential amplifying circuit 11*b*.

As a result, when the output voltage Vout lowers due to a steep change in the output electric current io, the output signal of the second amplifying circuit 15 changes and, the output signal of the third amplifying circuit 16 acting as a control signal carrying out control of operation of the output voltage returning circuit 6 turns on the NMOS transistor M13, and thus, the NMOS transistor M13 enters an electric conduction state. Thereby, the NMOS transistor M14 acting as the constant electric current source is connected to the gate of the output transistor M1, the gate capacitance of the output transistor M1 is thus discharged at high speed, and thereby, the output electric current io increases and the output voltage Vout returns to the predetermined voltage.

There, for example, such a configuration is provided that, an electric current driving capability of the PMOS transistor M9 is made larger than that of the PMOS transistor M5, and, thus, such a setting is made that, a voltage gain of the second amplifying circuit 15 is made larger than a voltage gain determined by the NMOS transistors M2, M4 and the PMOS transistor M5. When the same voltage is input, an output voltage level of the second amplifying circuit 15 becomes larger than an output voltage level from a connection point between the NMOS transistor M2 and the PMOS transistor M5. Thereby, in a steady state in which the load electric current is small, the output voltage level of the second amplifying circuit 15 is the power source voltage Vcc, the third amplifying circuit 16 outputs the ground voltage, and thus, the NMOS transistor M13 of the output voltage returning circuit 6 is turned off.

When the load electric current io lowers steeply and thus the output voltage Vout lowers, the output voltage level of the second amplifying circuit 15 lowers to the ground voltage, the third amplifying circuit 16 outputs the power source voltage Vcc, and thus, the NMOS transistor M13 of the output voltage returning circuit 6 is turned on. By this configuration, when the output voltage lowers even slightly, the output voltage returning circuit 6 functions to increase an electric current flowing through the NMOS transistor M2 and increase an output electric current of the output transistor M1. as a result, it is possible to instantaneously return from the reduction of the output voltage Vout. Further, when no steep reduction of the output voltage occurs, or the output electric current is very small, the output voltage returning circuit 6 does not operate, control of operation carried out in the error amplifying circuit 4*b* and the output transistor M1 is not affected, and thus, it is possible to provide the constant voltage circuit which can achieve high speed response with a reduced electric current consumption.

Figure 5:
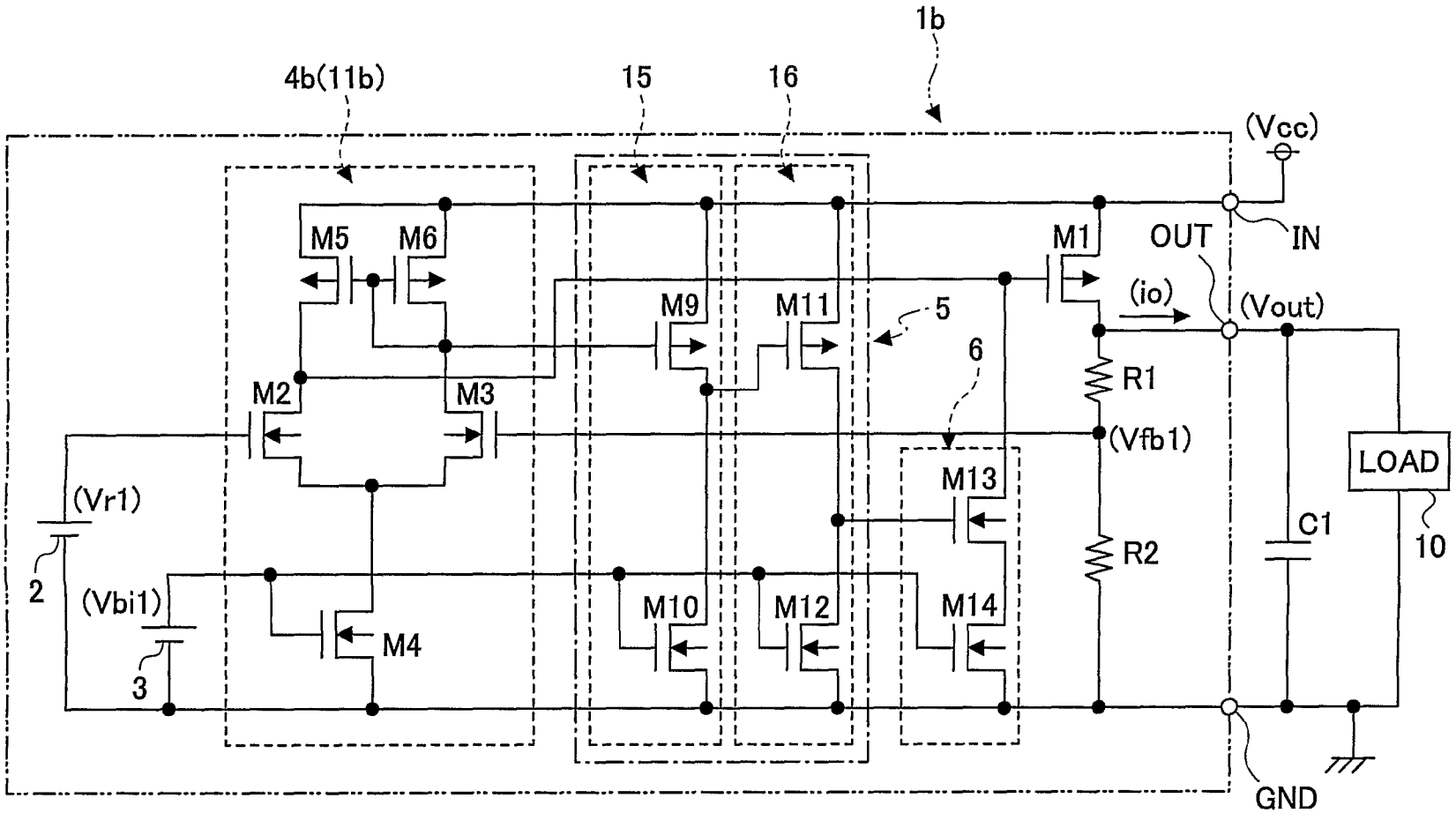
FIG. 5 shows another example of a configuration of a constant voltage circuit in the third embodiment of the present invention.

On one hand, although the output voltage returning circuit 6 is connected to the NMOS transistor 4 in parallel in FIG. 4, the output voltage returning circuit 6 may be instead connected between the gate of the output transistor M1 and the ground voltage as shown in FIG. 5. Operation of the output voltage returning circuit 6 in FIG. 5 is the same as that in FIG. 4, and the duplicate description will be omitted.

Thus, in the case where the error amplifying circuit 4*b* only includes the differential amplifying circuit 11*b*, the output voltage returning circuit 6 is connected to the NMOS transistor M4 acting as the constant electric current source of the differential amplifying circuit 11*b* in parallel, or, is connected between the gate of the output transistor M1 and the ground voltage. Thereby, the same effect as that of the first embodiment described above can be obtained.

It is noted that such a configuration may be provided that an electric current supplied by the NMOS transistor M14 acting as the constant electric current source is smaller than an electric current supplied by the NMOS transistor M4 acting as the constant electric current source.

Fourth Embodiment

An error amplifying circuit having a higher response speed may be used instead of the NMOS transistor M14 in the output voltage returning circuit 6 in the first through third embodiments described above. A fourth embodiment of the present invention has such a configuration.

Figure 6:
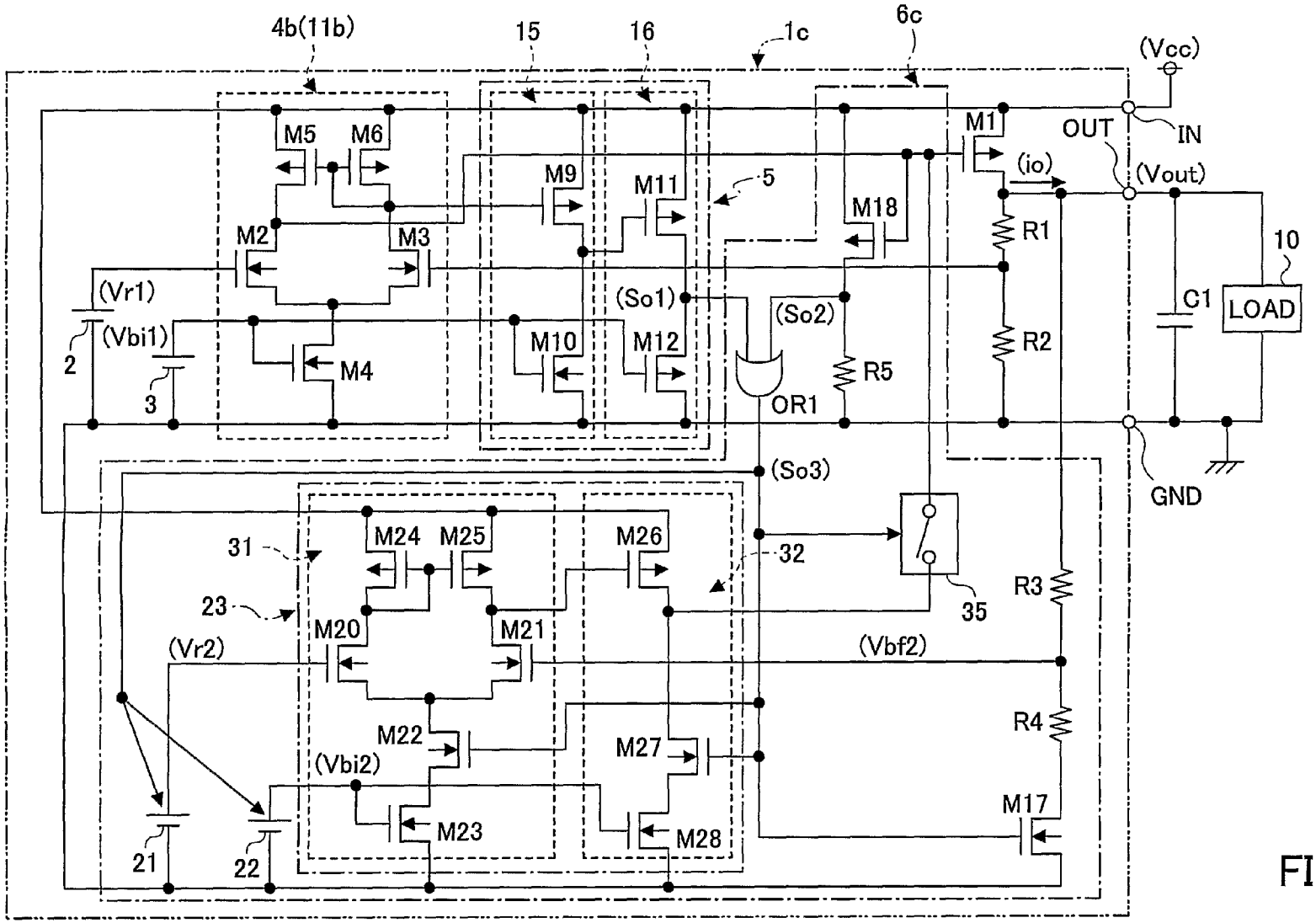
FIG. 6 shows an example of a configuration of a constant voltage circuit in a fourth embodiment of the present invention.
Figure 7:
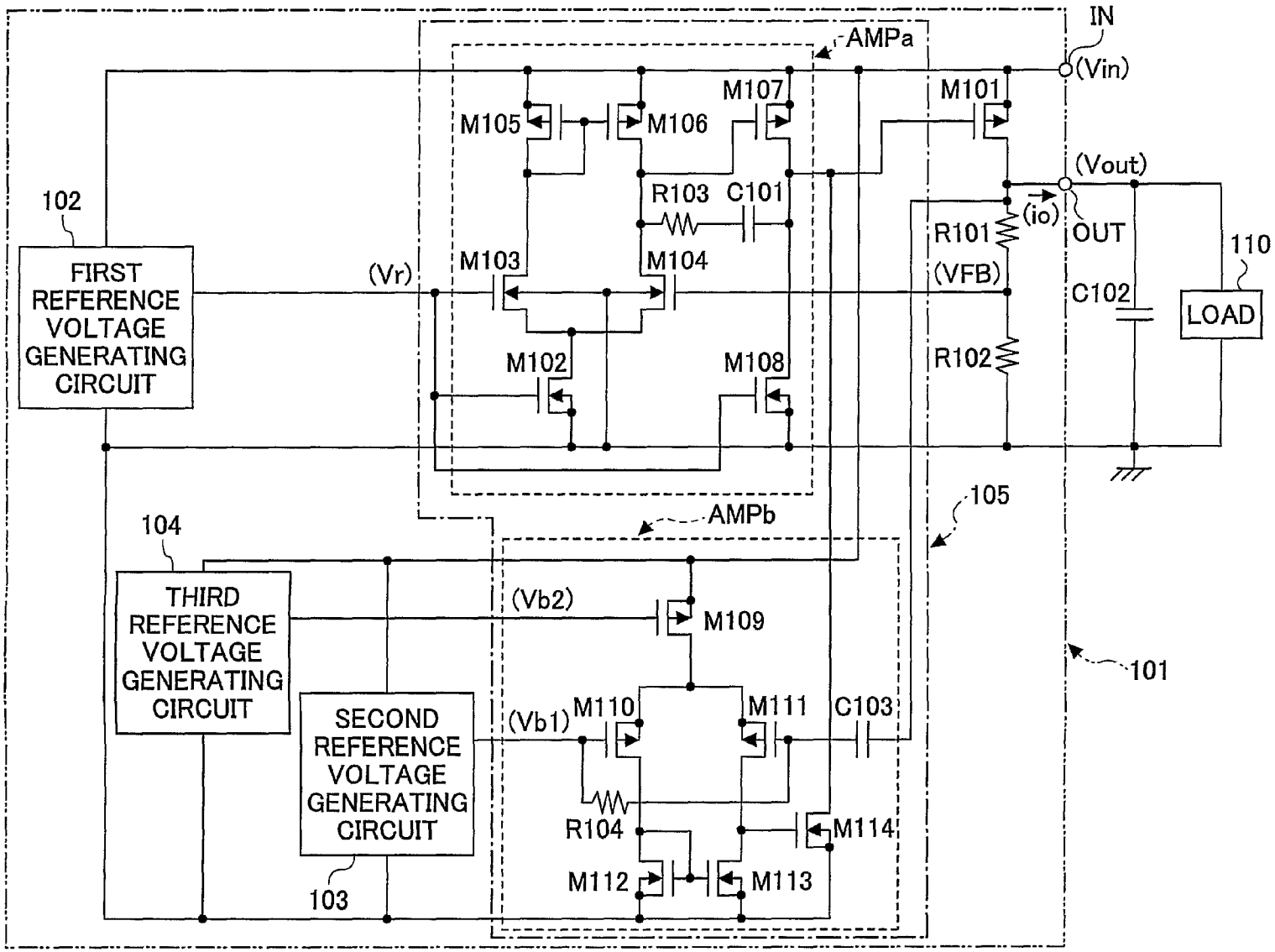
FIG. 7 shows an example of a configuration of a constant voltage circuit in the prior art.

FIG. 6 shows an example of a configuration of a constant voltage circuit in the fourth embodiment of the present invention. In FIG. 6, devices the same as those in FIG. 5 have the same reference numerals given, the duplicated description will be omitted, and only points different from those of FIG. 5 will be described.

The different points in FIG. 6 from FIG. 5 are that, in the output voltage returning circuit 6 of FIG. 5, the configuration of a switching circuit made by the NMOS transistor M13 is changed, and also, instead of the NMOS transistor M14 acting as the constant electric current source, an error amplifying circuit having a higher response speed than that of the error amplifying circuit 4*b* of FIG. 5 is used. Based thereon, the output voltage returning circuit 6 of FIG. 5 is changed into an output voltage returning circuit 6*c*, and the constant voltage circuit 1*b* of FIG. 5 is changed into a constant voltage circuit 1*c*.

In FIG. 6, the constant voltage circuit 1*c* generates a predetermined constant voltage from an input voltage Vcc input to an input terminal IN, and outputs the predetermined constant voltage as an output voltage Vout to a load 10 from an output terminal OUT. The constant voltage circuit 1*c* includes a reference voltage generating circuit 2, a bias voltage generating circuit 3, resistors R1, R2, an output transistor M1, an error amplifying circuit 4*b*, a voltage change detecting circuit 5, and an output voltage returning circuit 6*c* discharging a gate capacitance of the output transistor M1 and returning the output voltage Vout to the predetermined voltage. It is noted that, the output voltage returning circuit 6*c* acts as the above-mentioned discharging circuit part, and the constant voltage circuit 1*c* may be integrated in to a single IC (Integrated Circuit).

The output voltage returning circuit 6*c* includes a reference voltage generating circuit 21 generating a predetermined reference voltage Vr2 and outputting the same, a bias voltage generating circuit 22 generating a predetermined bias voltage Vbi2 and outputting the same, resistors R3, R4 for detecting the output voltage by outputting a divided voltage Vfb2 as a result of dividing the output voltage Vout, an NMOS transistor M17 acting as a switching device, and an error amplifying circuit 23 controlling operation of the output transistor M1 in such a manner that the divided voltage Vfb2 may be the reference voltage Vr2. Further, the output voltage returning circuit 6*c* includes a switching circuit 35, an OR circuit OR1, a PMOS transistor M18 and a resistor R5. The error amplifying circuit 23 has a response speed to a change in the output voltage Vout higher than that of the error amplifying circuit 4*b*, and includes a differential amplifying circuit 31 amplifying a voltage difference between the reference voltage Vr2 and the divide voltage Vfrb2, and outputting the amplified signal, and an amplifying circuit 32 amplifying the output signal of the differential amplifying circuit 31, and outputting the amplified signal, a source of which is grounded.

The error amplifying circuit 23 acts as the above-mentioned second error amplifying circuit; the PMOS transistor M18 and the resistor R5 act as the above-mentioned output electric current detecting circuit; and the OR circuit OR1 acts as the above-mentioned switching control circuit. The resistors R3, R4 and the NMOS transistor M17 act as the above-mentioned second output voltage detecting circuit; the reference voltage generating circuit 21 acts as the above-mentioned second reference voltage generating circuit; the divided voltage Vfb2 acts as the above-mentioned second proportional voltage, and the reference voltage Vr2 acts as the above-mentioned second reference voltage.

Between the input voltage Vcc and the ground voltage, the PMOS transistor M18 and the resistor R5 are connected in series, and a gate of the PMOS transistor M18 is connected to a gate of the output transistor M1. An output signal So1 of the third amplifying circuit 16 is input to one input end of the OR circuit OR1, and another input end of the OR circuit OR1 is connected to a connection point between the PMOS transistor M18 and the resistor R5, to which a signal So2 is input. A switching signal So3 which is an output signal of the OR circuit OR1 is output to each of the reference voltage generating circuit 21, the bias voltage generating circuit 22, the differential amplifying circuit 31, the amplifying circuit 32, the switching circuit 35 and a gate of the NMOS transistor M17. Further, between the output terminal OUT and the ground voltage, the resistors R3, R4 and the NMOS transistor M17 are connected in series, and the divided voltage Vfb2 is output from the connection point between the resistors R3, R4. The switching circuit 35 is connected between the gate of the output transistor and an output end of the amplifying circuit 32, and carries out switching operation according to the switching signal So3.

The differential amplifying circuit 31 includes NMOS transistors M20 through M23 and PMOS transistors M24, M25, and, the NMOS transistors M20 and M21 act as a differential pair, and the PMOS transistors M24 and M25 acting as a load of the differential pair configure a current-mirror circuit. The amplifying circuit 32 includes a PMOS transistor M26 and NMOS transistors M27, M28, connected in series between the input voltage Vcc and the ground voltage.

In the differential amplifying circuit 31, respective sources of the NMOS transistors M20 and M21 acting as the differential pair are connected and, between the connection point and the ground voltage, the NMOS transistors M22 and M23 are connected in series. To a gate of the NMOS transistor M22, the switching signal So3 is input, the bias voltage Vbi2 is input to a gate of the NMOS transistor M23, and the NMOS transistor M23 acts as a constant electric current source.

Respective gates of the PMOS transistors M24 and M25 are connected, and the connection point is connected to a drain of the PMOS transistor M24. The drain of the PMOS transistor M24 is connected to a drain of the NMOS transistor M20, a drain of the PMOS transistor M25 is connected to a drain of the NMOS transistor M21, and the input voltage Vcc is input to each of respective sources of the PMOS transistors M24 and M25. A gate of the NMOS transistor 20 acts as an inverted input end of the differential amplifying circuit 31, and the reference voltage Vr2 is input thereto. A gate of the NMOS transistor M21 acts as a non-inverted input end of the differential amplifying circuit 31, and, the divided voltage Vfb2 is input thereto. Further, the connection point between the PMOS transistor M25 and the NMOS transistor M21 acts as an output end of the differential amplifying circuit 31, and, is connected to a gate of the PMOS transistor M26 which acts as an input end of the amplifying circuit 32.

Next, in the amplifying circuit 32, between the input voltage Vcc and the ground voltage, the PMOS transistor M26 and the NMOS transistors M27, M28 are connected in series. To a gate of the NMOS transistor M28, the bias voltage Vbi2 is input, and the NMOS transistor M28 acts as a constant electric current source. To a gate of the NMOS transistor 27, the switching signal So3 is input, and the connection point between the PMOS transistor M26 and the NMOS transistor M27 is connected to a gate of the output transistor M1 via the switching circuit 35.

In the configuration, the second amplifying circuit 15 and the third amplifying circuit 16 operate the same as those in the third embodiment. When the output voltage Vout steeply lowers, the signal level of the output signal So1 of the third amplifying circuit 16 is inverted, and thus, in the case of FIG. 6, the output signal So1 rises up from a low level to a high level. Further, from the PMOS transistor M18, an electric current proportional to an electric current flowing through the output transistor M1 flows, this electric current is converted into a voltage by the resistor R5, and, as the signal So2, is input to the OR circuit OR1. Therefrom, the switching signal So3 has its signal level inverted as a result of the output electric current io increasing to be equal to or more than a predetermined value, and/or, the output electric current io steeply increasing and the output voltage Vout lowering.

The switching signal So3 is input to the switching circuit 35, and, when the output electric current io increases, and/or, the output electric current io steeply increases and the output voltage Vout lowers, the output end of the amplifying circuit 32 is connected to the gate of the output transistor M1 by means of the switching circuit 35 so that the error amplifying circuit 23 can control the output transistor M1. The error amplifying circuit 23 is designed to have an electric current consumption larger than that of the error amplifying circuit 4*b*, and can control the output transistor M1 at high speed. Thereby, when steep reduction of the output voltage Vout occurs, the error differential circuit 23 can discharge the capacitance of the gate electrode of the output transistor M1 at high speed, and thus, it is possible to instantaneously return the output voltage Vout to the predetermined voltage.

When the load electric current is small, the switching signal So3 have a low level by means of the signals So1 and So2, the reference voltage generating circuit 21 and the bias voltage generating circuit 22 stop their operation, also the NMOS transistors M17, M22 and M27 are turned off respectively, the error amplifying circuit 23 stop its operation, and thus, the output voltage returning circuit 6*c* enters a low electric current consumption state. At this time, the output transistor M1 is controlled in its operation only by the error amplifying circuit 4*b*. Next, when the load electric current increases, the switching signal So3 comes to have a high level by means of the signal So2, the reference voltage generating circuit 21 and the bias voltage generating circuit 22 operate, also the NMOS transistors M17, M22 and M27 are turned on respectively to enter their electric conduction states, the error amplifying circuit 23 operates, and thus, the output voltage returning circuit 6*c* operates. Thus, the constant voltage circuit 1*c* operates with a reduced electric current consumption when the load electric current is small, while, when the load electric current is large, high speed response is available.

Further, when the output voltage Vout lowers as a result of a steep increase in the output electric current io, the signal So1 causes the switching signal So3 to have a high level, the output voltage returning circuit 6*c* controls operation of the output transistor M1, reduction of the output voltage Vout is controlled, and thus, the output voltage Vout can be returned to the predetermined voltage at high speed.

It is note that, in FIG. 6, such a configuration may be provided that, when the output voltage returning circuit 6*c* controls operation of the output transistor M1 by means of the switching signal So3, not only the reference voltage generating circuit 2, the bias voltage generating circuit 3 and the error amplifying circuit 4*b* stop their operation respectively, but also the connection between the series circuit of the resistors R1 and R2 and the ground voltage is broken.

Further, in the output voltage returning circuit 6*c*, such a configuration may be provided that, instead of the reference voltage generating circuit 21, the reference voltage generating circuit 2 is used; instead of the bias voltage generating circuit 22, the bias voltage generating circuit 3 is used; instead of the divided voltage Vfb2, the divided voltage Vfb1 is used; and thus, the required number of the circuit devices can be reduced.

Further, the NMOS transistor M14 in each of the first through third embodiments should not particularly be configured to act as the constant electric current sources, when the gate capacitance of the output transistor M1 can be discharged at high speed thereby.

Further, in each of the first through fourth embodiments, such a configuration may be provided that the PMOS transistors are replaced by NMOS transistors, and also, the NMOS transistors are replaced by PMOS transistors.

Further, in each of the first through fourth embodiments, instead of the PMOS transistor M1, a bipolar transistor may be used.

Further, the present invention is not limited to the above-described embodiments, and variations and modifications may be made without departing from the basic concept of the present invention claimed below.

The present application is based on Japanese Priority Application No. 2006-130566, filed on May 9, 2006, the entire contents of which are hereby incorporated herein by reference.

The invention claimed is:

1. A constant voltage circuit converting an input voltage input from an input terminal into a predetermined constant voltage and outputting the same from an output terminal, comprising:

an output transistor outputting an electric current according to an input control signal from the input terminal, to the output terminal;

a control circuit part having a first error amplifying circuit carrying out operation control of the output transistor in such a manner that the a first proportional voltage proportional to the output voltage output from the output terminal may be a predetermined first reference voltage;

a voltage change detecting circuit part detecting a change of the output voltage output from the output terminal, and amplifying an output signal of a differential amplifying circuit included in the first error amplifying circuit, converting the amplified signal into a binary signal and outputting the binary signal; and a discharging circuit part amplifying a discharge electric current for discharging a capacitance parasitic on a control electrode of the output transistor, according to an output voltage from the voltage change detecting circuit part, wherein:

said voltage change detecting circuit part amplifies the output signal of the differential amplifying circuit so that a slew rate thereof may be larger than that of the control signal output from the first error amplifying circuit to the output transistor, responds to a change of the output voltage output from the output terminal quicker than the control signal output from the first error amplifying circuit to the output transistor, to cause the discharging circuit part to carry out discharging operation.

2. The constant voltage circuit as claimed in claim 1, wherein:

said voltage change detecting circuit part comprises:

a second amplifying circuit amplifying the output signal of the differential amplifying circuit and outputting the amplified signal; and a third amplifying circuit amplifying the output signal of the second amplifying circuit, converting the amplified signal into a binary signal and outputting the binary signal to the discharging circuit part, wherein:

said second amplifying circuit has a slew rate of the output signal larger than that of the output signal of the first error amplifying circuit.

3. The constant voltage circuit as claimed in claim 2, wherein:

said first error amplifying circuit comprises:

a differential amplifying circuit amplifying a voltage difference between the first proportional voltage and the first reference voltage, and outputting the amplified signal; and a first amplifying circuit amplifying an output signal of the differential amplifying circuit, and outputting the amplified signal to the control electrode of the output transistor, wherein:

said second amplifying circuit has a larger voltage gain than that of the first amplifying circuit.

4. The constant voltage circuit as claimed in claim 3, wherein:

said first amplifying circuit comprises:

a first transistor as a voltage amplifying device, the output signal of the differential amplifying circuit being input to a control electrode thereof; and a first electric current source providing a first bias electric current to the first transistor, wherein:

said second amplifying circuit comprises:

a second transistor as a voltage amplifying device, the output signal of the differential amplifying circuit being input to a control electrode thereof; and a second electric current source providing a second bias electric current, smaller than the first bias electric current, to the second transistor.

5. The constant voltage circuit as claimed in claim 3, wherein:

said first amplifying circuit comprises:

a first transistor as a voltage amplifying device, the output signal of the differential amplifying circuit being input to a control electrode thereof; and a first electric current source providing a first bias electric current to the first transistor, wherein:

said second amplifying circuit comprises:

a second transistor as a voltage amplifying device, the output signal of the differential amplifying circuit being input to a control electrode thereof, said second transistor having an electric current driving capability larger than that of the first transistor; and a second electric current source providing a second bias electric current to the second transistor.

6. The constant voltage circuit as claimed in claim 2, wherein:

said third amplifying circuit comprises:

a third transistor as a voltage amplifying device, the output signal of the second amplifying circuit being input to a control electrode thereof; and a third electric current source providing a third bias electric current to the third transistor, wherein:

said third amplifying circuit has a parasitic capacitance of the control electrode smaller than that of the output transistor.

7. The constant voltage circuit as claimed in claim 1, wherein:

said discharging circuit part comprises:

a fourth electric current source for discharging the capacitance of the control electrode of the output transistor; and a first switching device carrying out control of connecting between the control electrode of the output transistor and the fourth electric current source, according to the output signal of the voltage change detecting circuit part.

8. The constant voltage circuit as claimed in claim 7, wherein:

said discharging circuit part comprises:

a fifth electric current source for increasing a bias electric current to be supplied to a differential pair of the differential amplifying circuit; and a second switching device carrying out control of connecting between the differential amplifying circuit and the fifth electric current source, according to the output signal of the voltage change detecting circuit part, wherein:

said second switching device carries out the same connecting operation as that of the first switching device.

9. The constant voltage circuit as claimed in claim 2, wherein:

said first error amplifying circuit comprises a differential amplifying circuit amplifying a voltage difference between the first proportional voltage and the first reference voltage, and outputting the amplified signal, wherein a first signal output from a first output end which is one output end of the differential amplifying circuit is input to the control electrode of the output transistor, and a second signal output from a second output end which is another output end of the differential amplifying circuit is output to the second amplifying circuit of the voltage change detecting circuit part.

10. The constant voltage circuit as claimed in claim 9, wherein:

said second amplifying circuit has a slew rate of the output signal larger than that of the first signal of the differential amplifying circuit.

11. The constant voltage circuit as claimed in claim 9, wherein:

said differential amplifying circuit comprises:

a first input transistor, the first reference voltage being input to a control electrode thereof;

a second input transistor, the first proportional voltage being input to a control electrode thereof;

a first load circuit acting as a load of the first input transistor;

a second load circuit acting as a load of the second input transistor; and a bias electric current source supplying a bias electric current to the first input transistor and the second input transistor, wherein:

the first signal is output from a connection point between the first input transistor and the first load circuit, and the second signal is output from a connection point between the second input transistor and the second load circuit.

12. The constant voltage circuit as claimed in claim 11, wherein:

said second amplifying circuit has a voltage gain larger than a voltage gain determined by the first input transistor, the first load circuit and the bias electric current source.

13. The constant voltage circuit as claimed in claim 12, wherein:

said second amplifying circuit comprises:

a second transistor acting as a voltage amplifying device, the output signal of the differential amplifying circuit being input to a control electrode thereof; and a second electric current source supplying a second bias electric current to the second transistor, wherein:

said first load circuit and the second load circuit configure a current-mirror circuit in which the first load circuit acts as an input-side transistor and the second load circuit acts as an output-side transistor; and said second transistor has an electric current driving capability larger than that of the transistor acting as the first load circuit.

14. The constant voltage circuit as claimed in claim 11, wherein:

said discharging circuit part comprises:

a fourth electric current source for increasing a bias electric current supplied to the first input transistor and the second input transistor of the differential amplifying circuit;

a first switching device carrying out control of connecting between the differential amplifying circuit and the fourth electric current source, according to the output signal of the voltage change detecting circuit part.

15. The constant voltage circuit as claimed in claim 13, wherein:

said fourth electric current source supplies an electric current smaller than that of the bias electric current source.

16. The constant voltage circuit as claimed in claim 1, wherein:

said discharging circuit part comprises:

a second error amplifying circuit carrying out control of operation of the output transistor in such a manner that a second proportional voltage proportional to the output voltage output from the output terminal may be a predetermined second reference voltage, said second error amplifying circuit having a response speed higher than that of the first error amplifying circuit; and a switching circuit carrying out control of connecting between an output end of the second error amplifying circuit and the control electrode of the output transistor, according to the output signal of the voltage change detecting circuit part, wherein:

said voltage change detecting circuit part responds to a change of the output voltage output from the output terminal quicker than that of the control signal output to the output transistor from the first error amplifying circuit, to control the switching circuit so as to connect the output end of the second error amplifying circuit to the control electrode of the output transistor.

17. The constant voltage circuit as claimed in claim 16, wherein:

said first error amplifying circuit has an electric current consumption smaller than that of the second error amplifying circuit.

18. The constant voltage circuit as claimed in claim 16, wherein:

said discharging circuit part comprises:

an output electric current detecting circuit detecting a value of an electric current output from the output transistor, and outputting a predetermined signal when the thus-detected electric current value becomes not less than a predetermined value; and a switching control circuit carrying out control of operation of the switching circuit, according to the respective output signals of the voltage change detecting circuit part and the output electric current detecting circuit, wherein:

the switching control circuit causes the switching circuit to connect the output end of the second error amplifying circuit to the control electrode of the output transistor, when the signal from the voltage change detecting circuit part indicating that the output end of the second error amplifying circuit is connected to the control electrode of the output transistor and/or the signal from the output electric current detecting circuit indicating that the detected electric current becomes not less than the predetermined value is input.

19. The constant voltage circuit as claimed in claim 18, wherein:

said discharging circuit part comprises:

a second output voltage detecting circuit generating and outputting the second proportional voltage; and a second reference voltage generating circuit generating and outputting the second reference voltage, wherein:

said second error amplifying circuit, the second output voltage detecting circuit and the second reference voltage generating circuit stop their operations respectively, when the signal breaking the connection between the output end of the second error amplifying circuit and the control electrode of the output transistor is output to the switching circuit from the switching control circuit, so that an electric current consumption is reduced.

20. The constant voltage circuit as claimed in claim 16, wherein:

the second proportional voltage is equal to the first proportional voltage.

21. The constant voltage circuit as claimed in claim 16, wherein:

the second reference voltage is equal to the first reference voltage.

22. The constant voltage circuit as claimed in any one of claims 1 through 21, wherein:

the output transistor, the control circuit part, the voltage change detecting circuit part and the discharging circuit part are integrated in a single integrated circuit.

* * * * *